United States Patent [19]

Allen

[11] 4,099,699

[45] Jul. 11, 1978

[54] ANNULAR BLOWOUT PREVENTER

[75] Inventor: Herbert Allen, Houston, Tex.

[73] Assignee: Cameron Iron Works, Inc., Houston, Tex.

[21] Appl. No.: 721,968

[22] Filed: Sep. 10, 1976

[51] Int. Cl.[2] ..... E21B 33/06

[52] U.S. Cl. ..... 251/1 B; 251/5; 277/73

[58] Field of Search ..... 251/1 R, 1 B, 5; 277/3, 277/73, 127, 129; 166/84

[56] References Cited

U.S. PATENT DOCUMENTS

| | | | |
|---|---|---|---|
| 2,148,844 | 2/1939 | Stone et al. | 277/73 |
| 2,609,836 | 9/1952 | Knox | 277/73 |
| 2,760,750 | 8/1956 | Schweitzer et al. | 251/1 B |
| 2,812,197 | 11/1957 | Gibson | 251/1 B |
| 3,328,040 | 6/1967 | Prichard | 277/73 |
| 3,572,627 | 3/1971 | Jones | 251/1 B |
| 3,667,721 | 6/1972 | Vujasinovic | 277/73 X |

*Primary Examiner*—Martin P. Schwadron
*Assistant Examiner*—Richard Gerard

[57] ABSTRACT

There is disclosed an annular blowout preventer having a packer which is surrounded by an annulus of resilient material, and an operating system which includes means for longitudinally compressing the outer annulus in order to constrict its inner circumference and thereby move the packer from an expanded position, in which it opens the bore through a housing in which the packer and outer annulus are received, to a constricted position in which it closes the bore by sealing about a pipe in the bore or upon itself.

19 Claims, 6 Drawing Figures

ANNULAR BLOWOUT PREVENTER

This invention relates generally to improvements in annular blowout preventers for use in controlling pressure within an oil or gas well during drilling and completion of the well.

In an annular blowout preventor, a packer comprising an annulus of resilient material is received within a recess about the bore through the preventer housing for movement between an expanded, open-bore position and a constricted, bore-closing position in which it seals about a pipe in the bore or upon itself. In the particular type of annular preventer with which the present invention is concerned, another annulus of resilient material is disposed about the packer whereby, upon longitudinal compression of the outer annulus, its inner circumference is constricted about the packer to move it from expanded to constricted position and, upon relief of the compression in the outer annulus, its inner circumference is permitted to expand to permit the packer to move back to its expanded position.

FIGS. 30 to 34 of U.S. Pat. No. 2,609,836 show a preventer of this type wherein an annular piston is arranged with one end face engageable with one end of the outer annulus so as to longitudinally compress the outer annulus as the piston is hydraulically or mechanically operated. When the piston is operated hydraulically, and it is desired to return the packer to its expanded bore-opening position, hydraulic fluid is merely exhausted from the opposite face of the piston. As a result, the only force available to return the piston to its original position, and thus relieve the compression in the outer annulus, is that due to the tendency of both the packer annulus and outer annulus to return to their retracted positions. If this is insufficient, and return movement of the piston is incomplete, the packer obstructs the bore of the preventer. Also, the force on the piston for maintaining the packer in bore closing position is opposed by a force due to well fluid acting over the outer annulus. Therefore, as shown in such earlier patent, the opposite end face of the piston is enlarged to provide considerably greater area than the end face engaging the end of the outer annulus. Alternatively, a significant portion of the operating fluid pressure would have to be used to overcome the pressure of the well fluid.

An object of this invention is to provide an annular blowout preventer of this latter type having an hydraulically operated piston which may be returned to compression relieving position without reliance upon the tendencies of both the outer annulus and packer to return to expanded positions.

Another object is to provide such a preventer in which the piston need not be oversized and in which the pressure of the piston operating fluid need not be higher than that of the well fluid.

A further object is to provide such a preventer which is of a relatively simple construction which permits the packer to be replaced without disturbing the fluid operating system for compressing the outer annulus.

These and other objects are accomplished, in accordance with the illustrated embodiment of the present invention, by an annular blowout preventer of the type described having piston means longitudinally reciprocable within cylinder means formed within the housing, means for selectively admitting and exhausting operating fluid to and from the cylinder means on opposite sides of the piston means so as to reciprocate the piston means therein, a ring having a surface engageable with and substantially radially coextensive with one end of the outer annulus, and means connecting the ring to the piston means and extending sealably through guideway means connecting the cylinder means with the recess. Thus, the piston means may be moved in one longitudinal direction to cause the surface of the ring to longitudinally compress the outer annulus and thereby constrict its inner circumference in order to move the packer annulus from expanded to constricted position, and in the opposite longitudinal direction to relieve the compression in order to permit the inner circumference of the outer annulus to expand and thereby permit the packer to return to its expanded position. As will be understood, since the connecting means extends sealably through the guideway means to isolate the operating fluid from the well fluid, the piston means may be moved in the opposite direction to relieve compression in the outer annulus independently of the tendency of either annulus to return to its expanded position.

In the illustrated embodiment of the invention, each of the cylinder means, the piston means, and the guideway means is annular, and the connecting means is a sleeve. Preferably, the ring is moved upwardly to compress the outer annulus, and the sleeve has a cross-sectional area which is responsive to the pressure of well fluid within the recess and beneath the packer to urge the piston in an upward direction, thereby providing a force which assists that due to the operating fluid pressure acting on the piston in moving the packer to constricted position. Also, the resilient material of the outer annulus is preferably of a lower modulus of elasticity than that of the resilient material of the packer annulus, thereby enabling the outer annulus to be more readily compressed.

When the packer annulus is in expanded position, the lower ends of the ring and other annulus are disposed in an annular space in the recess which is lower than the upper and lower sides of a guideway within the recess between which the packer is slidable. Thus, the inner circumference of the outer annulus maintains contact about the entire outer circumference of the packer annulus as the outer annulus is so compressed. Preferably, the lower end of the outer annulus and the surface of the ring which engages it are shaped conically, so that, as the ring moves in a direction to constrict the packer, the surface assists in urging the outer annulus against the packer.

It is further preferred that the sleeve extend sealably through annular seal means which are carried by the housing at the inner and outer circumferences of the guideway and arranged to seal with the sleeve on substantially the same horizontal level. In this manner, there is no tendency for well pressure to provide a moment urging the sleeve outwardly against the outer side of the recess. This then makes it possible to use a sleeve for connecting the ring to the piston which is relatively thin, and which therefore does not unduly enlarge the radial dimensions of the recess and housing.

Figure 1:
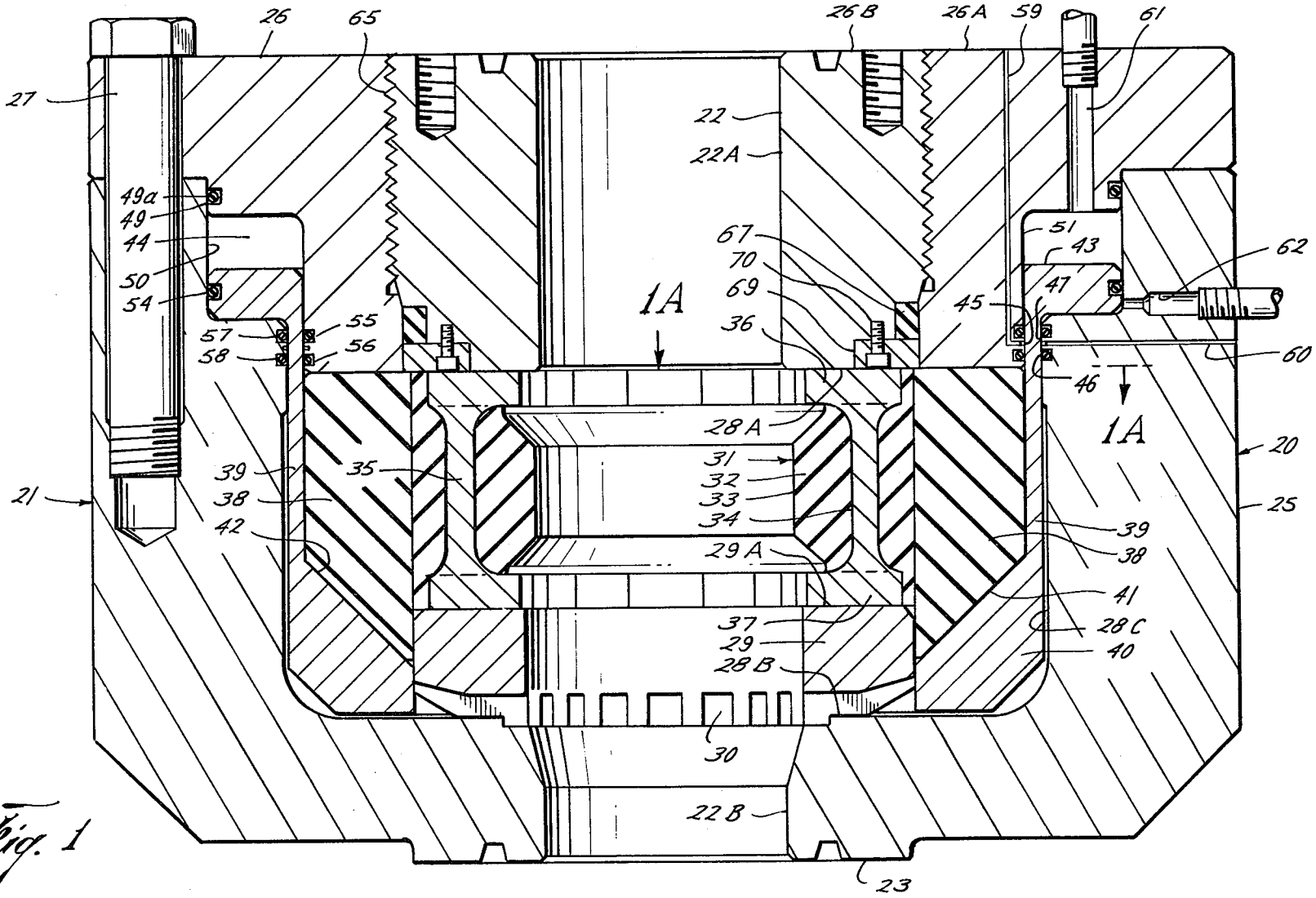
FIG. 1 is a vertical sectional view of an annular blowout preventer constructed in accordance with the present invention, and with the packer thereof shown in its expanded position.

With reference now to the details of the above-described drawings, the preventer, which is designated in its entirety by reference character 20, is shown to include a housing 21 having a bore 22 extending vertically therethrough. Suitable means are provided on the lower end 23 of the housing for sealably connecting it to a lower wellhead member, and on the upper end 24 thereof for sealably connecting it to an upper wellhead member. With the preventer 20 so installed in a wellhead, its bore 22 is aligned with the bores of the other wellhead members, and thus with the bore of the well therebelow.

Housing 21 is made up of a lower, generally cup-shaped body 25, and an upper, cap-like body 26 which, when connected to the lower body by means of bolts 27, form an annular recess 28 about the bore 22. The upper end 22A of bore 22 is formed in the upper body 26, and the lower end 22B of the bore is formed in the lower body 25. The upper end 28A of recess 28 is formed on the lower end of upper body 26, the lower end 28B of the recess is formed on an upwardly facing shelf of the lower body 25, and the outer side 28C of the recess is formed on the inner side of the upstanding wall of the lower body. A bridge 29 is mounted on the lower end of the recess 28 and has by-pass ports 30 formed therein for a purpose to be described hereinafter.

Figure 2:
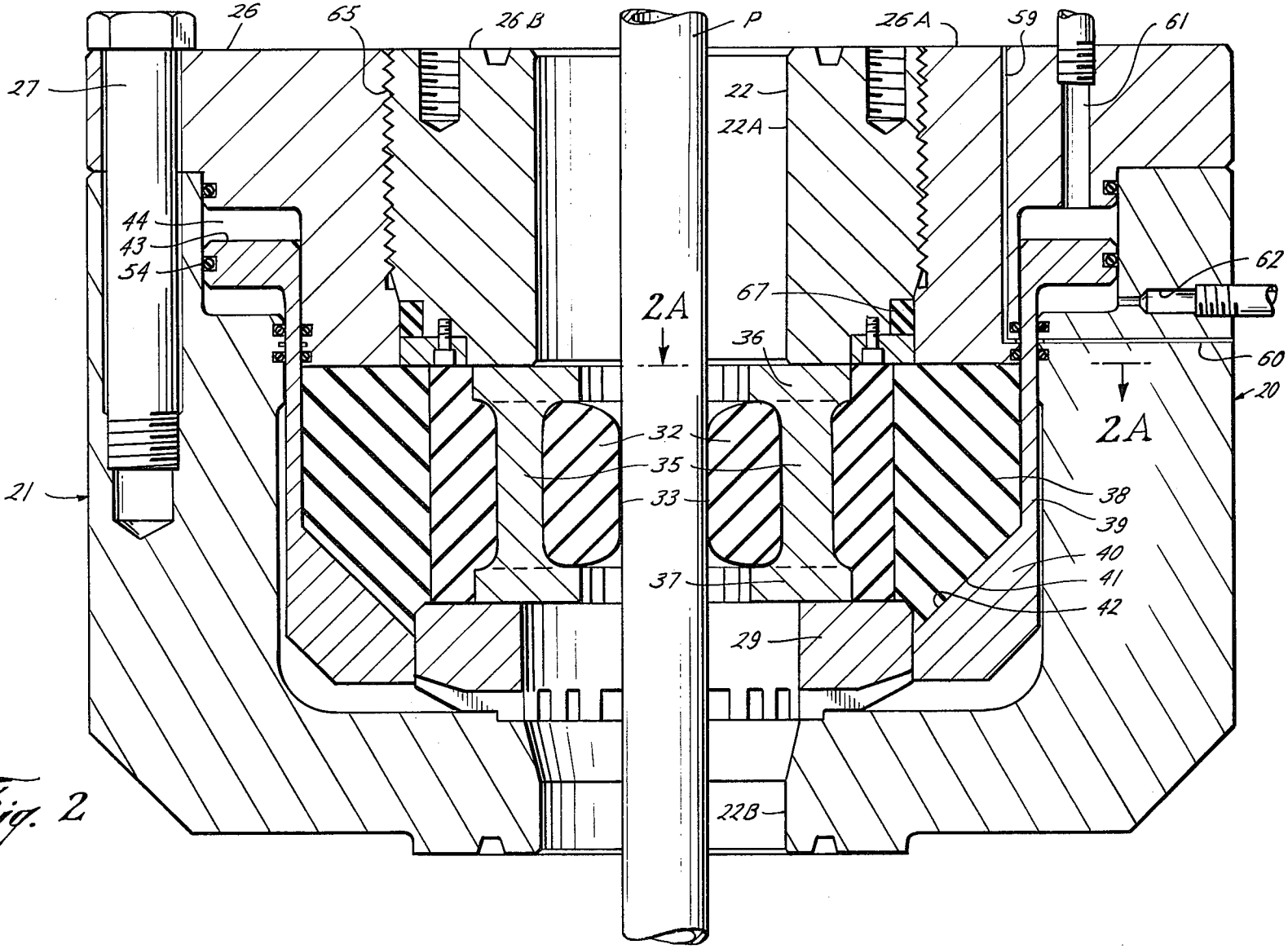
FIG. 2 is a vertical cross-sectional view of the preventer, similar to FIG. 1, but with the packer moved to constricted position to seal about a pipe within the bore of the preventer housing.
Figure 3:
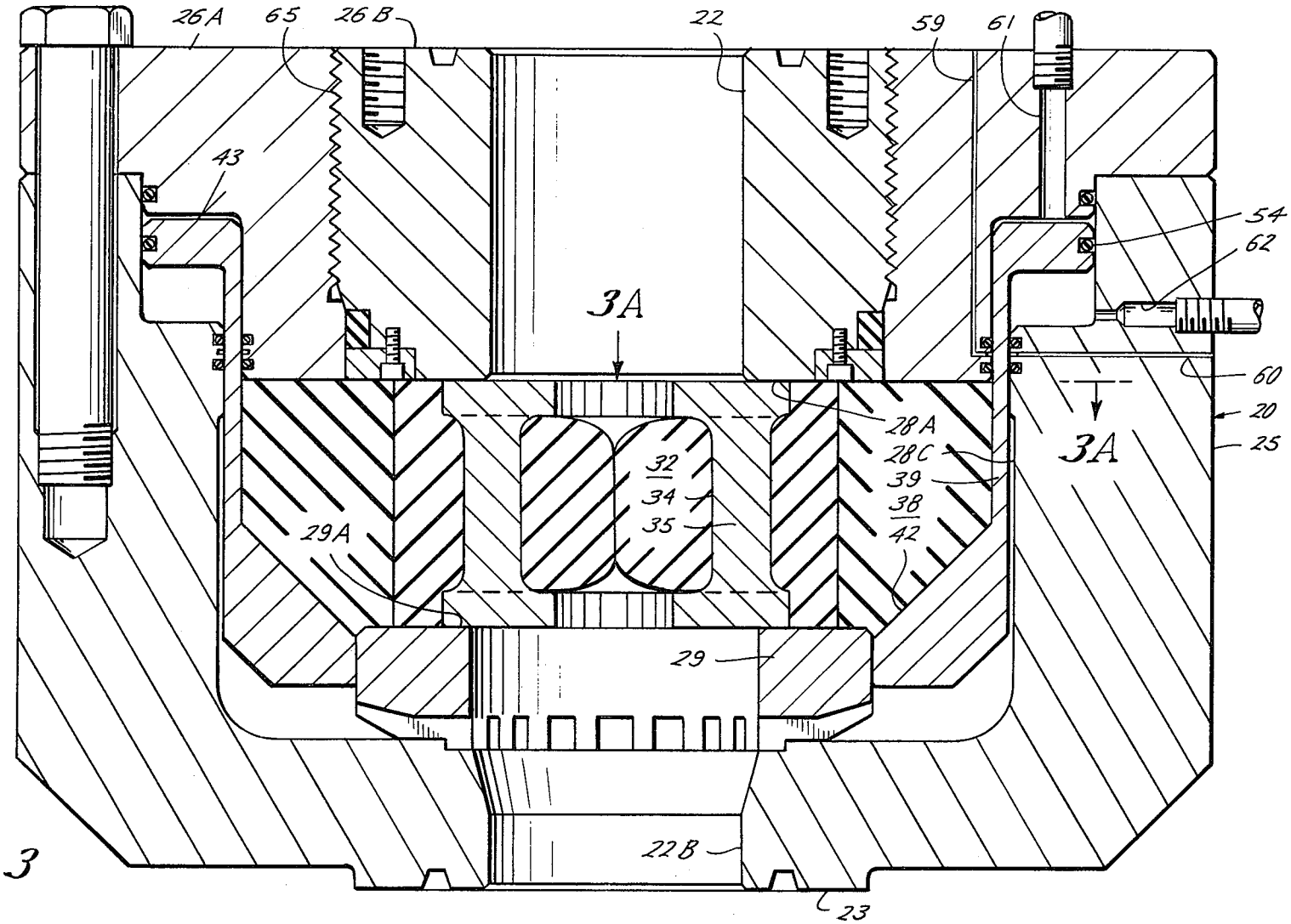
FIG. 3 is a vertical sectional view of the preventer, similar to FIGS. 1 and 2, but with the packer moved to a further constricted position so as to seal upon itself.

A packer 31 disposed within recess 28 includes an annulus 32 of resilient material which is confined top and bottom within a guideway formed by the upper end 28A of the recess and upper bridge surface 29A for sliding between an expanded position, as shown in FIG. 1, and constricted positions, as shown in FIGS. 2 and 3. In the expanded position of the annulus, its inner circumference 33, forms a substantial continuation of the bore 22 through the housing. When the annulus is constricted, its inner circumference may seal about a pipe P or other object within the well bore, as shown in FIG. 2, or upon itself, as shown in FIG. 3.

Packer 31 also includes rigid inserts 34 imbedded within the annulus 32 and preferably substantially identical in construction and function to the inserts of the packers shown in U.S. Pat. No. 3,572,627. Thus, each includes a vertical rib 35 having flanges 36 and 37 at its ends which slide over the upper and lower sides of the recess guideway as the packer moves between expanded and constricted positions. The radially outer ends of the flanges terminate inwardly of the outer diameter of the annulus, so as to provide an annular top surface of the annulus to sealably engage upper end 28A of the recess.

Figure 1A:
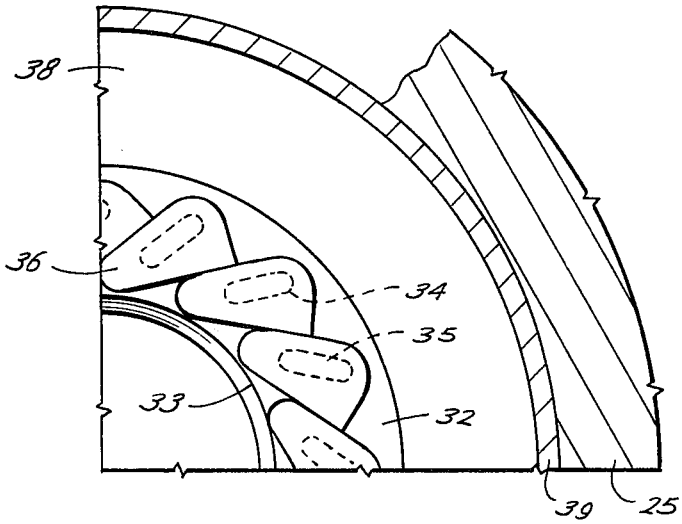
FIG. 1A is a partial sectional view of the preventer, as seen along broken lines 1A—1A of FIG. 1.
Figure 2A:
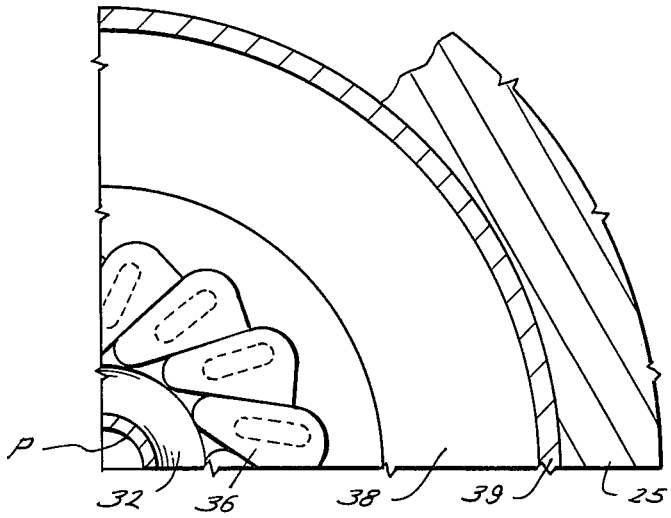
FIG. 2A is a partial sectional view of the preventer, as seen along broken lines 2A—2A of FIG. 2.
Figure 3A:
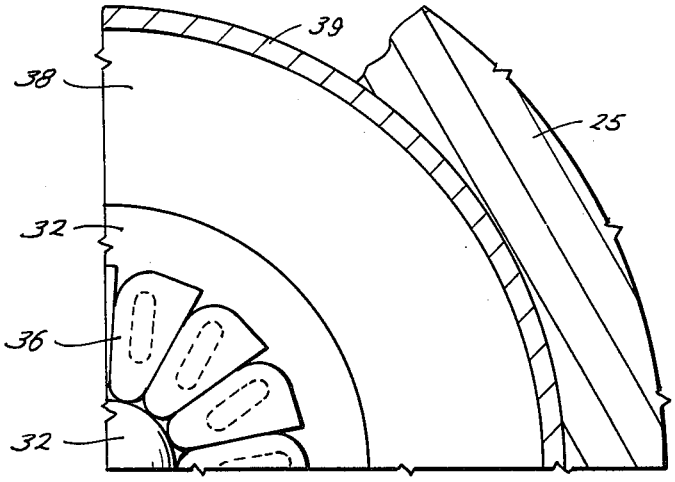
FIG. 3A is a partial sectional view of the preventer, as seen along broken lines 3A—3A of FIG. 3.

As shown in FIGS. 2A and 3A, as well as in the aforementioned U.S. Pat. No. 3,572,627, flanges 36 and 37 at opposite ends of the rigid inserts are of a modified triangular shape and are arranged in side-by-side sliding engagement so as to cause them to swing from the positions shown in FIG. 1A to the position shown in FIGS. 2A and 3A. Thus, the inserts swing into more radial positions, and the effective radial extents of the flanges are lengthened.

An outer annulus 38 of resilient material surrounds the packer annulus within the recess 28, with its inner circumference fitting closely about the outer circumference of the packer annulus. When the outer annulus is in a relaxed state, its inner circumference is expanded to permit the packer to assume its expanded position. However, when the outer annulus is longitudinally compressed, as shown in FIGS. 2 and 3, its inner circumference is constricted so as to move the packer annulus to constricted position. Then, upon relief of the longitudinal compression to permit the inner circumference of the outer annulus to expand, to packer is free to move back to its expanded position. The outer annulus is preferably made of a resilient material having a lower modulus of elasticity than that of the packer annulus, whereby it is more readily compressable to perform its intended function.

A sleeve 39 closely surrounds the outer circumference of the outer annulus 38 and fits relatively closely within the outer side 28C of recess 28. A ring 40 extends radially inwardly from the lower end of the sleeve and has an upper surface 42 which engages the lower end surface 41 of outer annulus 38. More particularly, this surface is substantially radially coextensive of the end surface of the outer annulus in its relaxed state. The lower end surface of the outer annulus and the upper surface of the ring are conically shaped and extend downwardly and inwardly from their outer to their inner circumferences so as to urge the outer annulus inwardly against the packer annulus as the outer annulus is longitudinally compressed to constrict its inner circumference.

The upper end of outer annulus 38 is horizontally coextensive with the upper end of the packer, and thus engages the upper end 28A of the recess. The lower ends of the ring and outer annulus are received within an annular space in the recess radially outwardly of bridge 29, and thus lower than the lower side of the recess guideway. Thus, as the outer annulus is moved into the positions shown in FIGS. 2 and 3, its inner circumference is maintained in contact with the entire vertical extent of the outer circumference of packer annulus 32.

Ring 40 is lifted, in order to longitudinally compress the outer annulus, by an annular piston 43 connected to the upper end of sleeve 39 and reciprocable within a cylinder 44 formed within housing 21. The upper end of sleeve 39 is sealably slidable within an annular guideway 47 in the housing connecting the cylinder with recess 28. Operating fluid within the cylinder is isolated from well fluid pressure within the recess 28 by means of seals 55, 56, 57 and 58 carried within grooves in the guideway for sealing engagement with the sleeve.

Lower body 25 has a counterbored portion 50 at its upper end, and upper body 26 has a reduced diameter portion 49 on its lower side which fits closely within portion 50. Upper body 26 also has a further reduced diameter portion 51 which includes an outer circumferential wall 45 which extends downwardly into and is spaced from an inner circumferential wall 46 of an upward continuation of outer wall 28C of recess 28 to form guideway 47 for sleeve 39 therebetween. Cylinder 44 is formed between oppositely facing surfaces of bodies 26 and 25 of the preventer housing, and a seal ring **49*a* carried by portion 49 seals with portion 50** to sealably close the upper end of the housing.

A seal ring 54 is carried on piston 43, and passageways 59 and 60 vent guideway 47 intermediate seals 55 and 56 and seals 57 and 58, respectively, to prevent leakage from recess 28 into cylinder 44. A port 61 extends through upper body 26 to the upper end of the cylinder, and a port 62 extends through lower body 25 to the lower end. Thus, operating pressure fluid may be selectively admitted or exhausted from the upper and lower ends of the piston to control its reciprocation and thus raise or lower sleeve 39.

Well pressure beneath the annulus has access through ports 30 of bridge 29 to the recess behind the packer to assist in maintaining it sealably engaged with the pipe. Well pressure is also effective over the cross-sectional area of sleeve 39 of piston 43 to provide an upwardly directed force which assists in urging the piston and thus the ring 40 in an upward, packer constricting direction. Thus, the packer is constricted into engagement with the pipe P not only by the force due to operating fluid admitted through passageway 62, but also by the additional force due to well fluid acting on the packer and on the piston.

Removal of the upper body 26 from the lower body 25 permits access to not only the packer annulus and the outer annulus 38, but also to the piston, sleeve and ring 40 of the operating system. The upper body includes outer and inner sections 26A and 26B threadedly connected to one another at 65, and the outer circumference of body section 26B is slightly larger than the outer circumference of packer 32 in its expanded position. Thus, inner section 26B alone may be removed to permit replacement and repair of the packer 31 separately of the outer annulus and operating system.

The inner and outer upper body sections are sealed with respect to one another by means of a seal ring 67 which is held in place by a retainer ring 69 connected to inner section 26B by means of bolts 70.

To summarize, actuation of the operating system to lift ring 40 from its lower position of FIG. 1 will longitudinally compress outer annulus 38, thereby causing its inner circumference to constrict and thus move the packer toward constricted position. The resilient material of the outer annulus flows relatively easily during this longitudinal compression due to the fact that it is not reinforced with rigid enforcements and that it has a relatively low modulus. In the event a pipe P is disposed within the bore of the preventer, lifting of the ring to the position of FIG. 2 will bring the inner circumference 33 of packer annulus 32 into sealing engagement about the pipe. In the event pipe P is not disposed in the bore, and it is desired to seal the packer upon itself, piston 43 is moved further upwardly to raise the ring 40 to the position shown in FIG. 3. When the packer is constricted to seal upon a pipe or upon itself, well pressure acts over the outer side of the packer to help maintain it in such position with a force proportional to that of the well fluid.

When it is desired to permit the packer to return to expanded position, operating fluid is exhausted from beneath piston 43 while being admitted to the upper side thereof so as to cause it to move downwardly and thus lower the ring 40. As the ring lowers, it relieves the longitudinal compression in the outer annulus 38, thereby permitting the inner circumference of the outer annulus to expand and the packer to return to its expanded position, as shown in FIG. 1.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. An annular blowout preventer, comprising a housing having a bore extending longitudinally therethrough and an annular recess about the bore, a packer comprising an annulus of resilient material mounted in the recess for movement between an expanded position to open the bore and a constricted position to seal about a pipe in the bore or upon itself, another annulus of resilient material surrounding the packer within the recess for moving the packer from expanded to constricted position upon constriction of the inner circumference of the outer annulus, said other annulus having a lower modulus of elasticity than that of the resilient material of the packer annulus, said housing having a cylinder means therein and guideway means connecting the cylinder means with the recess, piston means longitudinally reciprocable within the cylinder means, means for selectively admitting and exhausting operating fluid to and from the cylinder means on opposite sides of the piston means so as to reciprocate the piston means, a ring having a surface engageable with and substantially radially coextensive with one end of the outer annulus, and means extending sealably through the guideway means and connecting the ring to the piston means, whereby upon movement of the piston means in one direction, the ring longitudinally compresses the outer annulus so as to constrict its inner circumference and thereby move said packer from expanded to constricted position, and upon movement of the piston means in the opposite direction, said ring relieves the compression in said outer annulus to permit its inner circumference to expand and thereby permit said packer to move from constricted to expanded position.

2. An annular blowout preventer, comprising a housing having a bore extending longitudinally therethrough and an annular recess about the bore, having upper and lower sides and an annular space which extends lower than the lower side, a packer comprising an annulus of resilient material mounted in the recess for sliding movement along the upper and lower sides thereof between an expanded position to open the bore and a constricted position to seal about a pipe in the bore or upon itself, another annulus of resilient material surrounding the packer within the recess for moving the packer from expanded to constricted position upon constriction of the inner circumference of the outer annulus, said housing having a cylinder means therein and guideway means connecting the cylinder means with the recess, piston means longitudinally reciprocable within the cylinder means, means for selectively admitting and exhausting operating fluid to and from the cylinder means on opposite sides of the piston means so as to reciprocate the piston means, a ring beneath the outer annulus having a surface engageable with and substantially radially coextensive with the lower end of the outer annulus, and means extending sealably through the guideway means and connecting the ring to the piston means, whereby upon movement of the piston means in one direction, the ring longitudinally compresses the outer annulus so as to constrict its inner circumference to thereby move said packer from expanded to constricted position, and upon movement of the piston means in the opposite direction, said ring relieves the compression in said outer annulus to permit its inner circumference to expand and thereby permit said packer to move from constricted to expanded position, the lower ends of said ring and outer annulus being disposed within said annular space of the recess when said packer is in expanded position, so that, upon upward movement of the ring, the outer annulus remains in contact with the entire outer circumference of the packer.

3. An annular blowout preventer, comprising a housing having a bore extending longitudinally therethrough and an annular recess about the bore, a packer comprising an annulus of resilient material mounted in the recess for movement between an expanded position to open the bore and a constricted position to seal about a pipe in the bore or upon itself, another annulus of resilient material surrounding the packer within the recess for moving the packer from expanded to constricted position upon constriction of the inner circumference of the outer annulus, said housing having a cylinder means therein and guideway means connecting the cylinder means with the recess, piston means longitudinally reciprocable within the cylinder means, means for selectively admitting and exhausting operating fluid to and from the cylinder means on opposite sides of the piston so as to reciprocate the piston means, a ring having a conically shaped surface engageable with and substantially radially coextensive with a conically shaped end of the outer annulus, and means extending sealably through the guideway means and connecting the ring to the piston means, whereby upon movement of the piston means in one direction, the ring longitudinally compresses the outer annulus so as to constrict its inner circumference and thereby move said packer from expanded to constricted position, and upon movement of the piston means in the opposite direction, said ring relieves the compression in said outer annulus to permit its inner circumference to expand and thereby permit said packer to move from constricted to expanded position.

4. An annular blowout preventer, comprising a housing having a bore extending longitudinally therethrough and an annular recess about the bore, a packer comprising an annulus of resilient material mounted in the recess for movement between an expanded position to open the bore and a constricted position to seal about a pipe in the bore or upon itself, another annulus of resilient material surrounding the packer within the recess for moving the packer from expanded to constricted position upon constriction of the inner circumference of the outer annulus, said housing having an annular cylinder therein and an annular guideway connecting the cylinder with the recess adjacent the outer circumference of the outer annulus, an annular piston longitudinally reciprocable within the cylinder, means for selectively admitting and exhausting operating fluid from and to the cylinder on opposite sides of the piston so as to reciprocate the piston therein, a sleeve connected to the piston and extending through the guideway to surround the outer annulus within the recess, annular seal means carried by the housing at the inner and outer circumferences of the annular guideway and arranged to seal with the sleeve on substantially the same horizontal level, a ring extending radially inwardly from the sleeve and having a surface engageable with and substantially coextensive with one end of the outer annulus, whereby upon movement of the piston in one direction, the ring longitudinally compresses the outer annulus so as to constrict its inner circumference and thereby move said packer to constricted position, and upon movement of the piston in the opposite direction, said ring relieves the compression in said outer annulus so as to permit its inner circumference to expand and thereby permit said packer to move from constricted to retracted position.

5. An annular blowout preventer, comprising a housing having a bore extending longitudinally therethrough and an annular recess about the bore, a packer comprising an annulus of resilient material mounted in the recess for movement between an expanded position to open the bore and a constricted position to seal about a pipe in the bore or upon itself, another annulus of resilient material surrounding the packer within the recess for moving the packer from expanded to constricted position upon constriction of the inner circumference of the outer annulus, the resilient material of the outer annulus having a lower modulus of elasticity than that of the resilient material of the packer annulus, said housing having an annular cylinder therein and an annular guideway connecting the cylinder with the recess adjacent the outer circumference of the outer annulus, an annular piston longitudinally reciprocable within the cylinder, means for selectively admitting and exhausting operating fluid from and to the cylinder on opposite sides of the piston so as to reciprocate the piston therein, a sleeve connected to the piston and extending sealably through the guideway to surround the outer annulus within the recess, a ring extending radially inwardly from the sleeve and having a surface engageable with and substantially coextensive with one end of the outer annulus, whereby upon movement of the piston in one direction, the ring longitudinally compresses the outer annulus so as to constrict its inner circumference and thereby move said packer to constricted position, and upon moement of the piston in the opposite direction, said ring relieves the compression in said outer annulus so as to permit its inner circumference to expand and thereby permit said packer to move from constricted to retracted position.

6. An annular blowout preventer, comprising a housing having a bore extending longitudinally therethrough and an annular recess about the bore, a packer comprising an annulus of resilient material mounted in the recess for movement between an expanded position to open the bore and a constricted position to seal about a pipe in the bore or upon itself, another annulus of resilient material surrounding the packer within the recess for moving the packer from expanded to constricted position upon constriction of the inner circumference of the outer annulus, said housing having an annular cylinder therein and an annular guideway connecting the cylinder with the recess adjacent the outer circumference of the outer annulus, an annular piston longitudinally reciprocable within the cylinder, means for selectively admitting and exhausting operating fluid from and to the cylinder on opposite sides of the piston so as to reciprocate the piston therein, a sleeve connected to the piston and extending sealably through the guideway to surround the outer annulus within the recess, a ring extending radially inwardly from the sleeve and having a conically shaped surface engageable with and substantially coextensive with a conically shaped end of the outer annulus, whereby upon movement of the piston in one direction, the ring longitudinally compresses the outer annulus so as to constrict its inner circumference and thereby move said packer to constricted position, and upon movement of the piston in the opposite direction, said ring relieves the compression in said outer annulus so as to permit its inner circumference to expand and thereby permit said packer to move from constricted to retracted position.

7. An annular blowout preventer, comprising a housing having a bore extending longitudinally therethrough and an annular recess about the bore, having upper and lower sides and an annular space which extends lower than the lower side, a packer comprising an annulus of resilient material mounted in the recess for sliding movement along the upper and lower sides thereof between an expanded position to open the bore and a constricted position to seal about a pipe in the bore or upon itself, another annulus of resilient material surrounding the packer within the recess for moving the packer from expanded to constricted position upon constriction of the inner circumference of the outer annulus, said housing having an annular cylinder therein and an annular guideway connecting the cylinder with the recess adjacent the outer circumference of the outer annulus, an annular piston longitudinally reciprocable within the cylinder, means for selectively admitting and exhausting operating fluid from and to the cylinder on opposite sides of the piston so as to reciprocate the piston therein, a sleeve connected to the piston and extending sealably through the guideway to surround the outer annulus within the recess, a ring beneath the outer annulus extending radially inwardly from the sleeve and having a surface engageable with and substantially coextensive with the lower end of the outer annulus, whereby upon movement of the piston in one direction, the ring longitudinally compresses the outer annulus so as to constrict its inner circumference and thereby move said packer to constricted position, and upon movement of the piston in the opposite direction, said ring relieves the compression in said outer annulus so as to permit its inner circumference to expand and thereby permit said packer to move from constricted to retracted position, the lower ends of said ring and outer annulus being disposed within said annular space when said packer is in expanded position, so that, upon upward movement of the ring, the outer annulus remains in contact with the entire outer circumference of the packer.

8. An annular blowout preventer, comprising a housing having a bore extending longitudinally therethrough and an annular recess about the bore, a packer comprising an annulus of resilient material mounted in the recess for movement between an expanded position to open the bore and a constricted position to seal about a pipe in the bore or upon itself, another annulus of resilient material surrounding the packer with the recess for moving the packer from expanded to constricted position upon constriction of the inner circumference of the outer annulus, said housing having a cylinder means therein and guideway means connecting the cylinder means with the recess, piston means longitudinally reciprocable within the cylinder means, means for selectively admitting and exhausting operating fluid to and from the cylinder means on opposite sides of the piston means so as to reciprocate the piston means, a ring having a surface engageable with and substantially radially coextensive with one end of the outer annulus, means extending sealably through the guideway means and connecting the ring to the piston means, whereby upon movement of the piston means in one direction, the ring longitudinally compresses the outer annulus so as to constrict its inner circumference and thereby move said packer from expanded to constricted position, and upon movement of the piston means in the opposite direction, said ring relieves the compression in said outer annulus to permit its inner circumference to expand and thereby permit said packer to move from constricted to expanded position, and means fluidly communicating the housing bore beneath the packer with said recess on the opposite surface of said ring, whereby a force due to the pressure of well fluid acting upon said outer annulus assists the force due to said operating fluid in moving the packer to and maintaining the packer in constricted position.

9. An annular blowout preventer, comprising a housing having a bore extending longitudinally therethrough and an annular recess about the bore, a packer comprising an annulus of resilient material mounted in the recess for movement between an expanded position to open the bore and a constricted position to seal about a pipe in the bore or upon itself, another annulus of resilient material surrounding the packer within the recess for moving the packer from expanded to constricted position upon constriction of the inner circumference of the outer annulus, said housing having a cylinder means therein and guideway means concerning the cylinder means with the recess, piston means longitudinally reciprocable within the cylinder means, means for selectively admitting and exhausting operating fluid to and from the cylinder means on opposite sides of the piston means so as to reciprocate the piston means, a ring arranged lower than the piston means and having a surface engageable with and substantially radially coextensive with one end of the outer annulus, and means extending sealably through the guideway means and connecting the ring to the piston means, whereby upon movement of the piston means in one direction, the ring longitudinally compresses the outer annulus so as to constrict its inner circumference and thereby move said packer from expanded to constricted position, and upon movement of the piston means in the opposite direcion, said ring relieves the compression in said outer annulus to permit its inner circumference to expand and thereby permit said packer to move from constricted to expanded position.

10. An annular blowout preventer, comprising a housing having a bore extending longitudinally therethrough and an annular recess about the bore, a packer comprising an annulus of resilient material mounted in the recess for movement between an expanded position to open the bore and a constricted position to seal about a pipe in the bore or upon itself, another annulus of resilient material surrounding the packer within the recess for moving the packer from expanded to constricted position upon constriction of the inner circumference of the annulus, said housing having a cylinder means therein and guideway connecting the cylinder means with the recess, piston means longitudinally reciprocable within the cylinder means, means for selectively admitting and exhausting operating fluid to and from the cylinder means on opposite sides of the piston means so as to reciprocate the piston means, a ring having an upper surface engageable with and substantially radially coextensive with the lower end of the outer annulus, and means extending sealably through the guideway means and connecting the ring to the piston means, whereby upon movement of the piston means in one direction, the upper surface of the ring moves upwardly against the lower end of the outer annulus to longitudinally compress said outer annulus so as to constrict its inner circumference and thereby move said packer from expanded to constricted position, and upon movement of the piston means in the opposite direction, said ring relieves the compression in said outer annulus to permit its inner circumference to expand and thereby permit said packer to move from constricted to expanded position.

11. An annular blowout preventer of the character defined in claim 10, wherein the piston means is higher than the ring so as to lift the ring to compress the outer annulus.

12. An annular blowout preventer, comprising a housing having a bore extending longitudinally therethrough and an annular recess about the bore, a packer comprising an annulus of resilient material mounted in the recess for movement between an expanded position to open the bore and a constricted position to seal about a pipe in the bore or upon itself, another annulus of resilient material surrounding the packer within the recess for moving the packer from expanded to constricted position upon constriction of the inner circumference of the outer annulus, said housing having an annular cylinder therein and an annular guideway connecting the cylinder with the recess adjacent the outer circumference of the outer annulus, an annular piston longitudinally reciprocable within the cylinder, means for selectively admitting and exhausting operating fluid from and to the cylinder on opposite sides of the piston so as to reciprocate the piston therein, a sleeve connected to the piston and extending sealably through the guideway to surround the outer annulus within the recess, a ring extending radially inwardly from the sleeve and having a surface engageable with and substantially coextensive with one end of the outer annulus, whereby upon movement of the piston in one direction, the ring longitudinally compresses the outer annulus so as to constrict its inner circumference and thereby move said packer to constricted position, and upon movement of the piston in the opposite direction, said ring relieves the compression in said outer annulus so as to permit its inner circumference to expand and thereby permit said packer to move from constricted to retracted position, and means fluidly communicating the housing bore beneath the packer with said recess on the opposite surface of said ring, whereby a force due to the well fluid acting upon said outer annulus assist the force due to said operating fluid in moving the packer to and maintaining the packer in constricted position.

13. An annular blowout preventer, comprising a housing having a bore extending longitudinally therethrough and an annular recess about the bore, a packer comprising an annulus of resilient material mounted in the recess for movement between an expanded position to open the bore and a constricted position to seal about a pipe in the bore or upon itself, another annulus of resilient material surrounding the packer within the recess for moving the packer from expanded to constricted position upon constriction of the inner circumference of the outer annulus, said housing having an annular cylinder therein and an annular guideway connecting the cylinder with the recess adjacent the outer circumference of the outer annulus, an annular piston longitudinally reciprocable within the cylinder, means for selectively admitting and exhausting operating fluid from and to the cylinder on opposite sides of the piston so as to reciprocate the piston therein, a sleeve connected to the piston and extending sealably through the guideway to surround the outer annulus within the recess, a ring arranged lower than the piston and extending radially inwardly from the sleeve and having a surface engageable with and substantially coextensive with one end of the outer annulus, whereby upon movement of the piston in one direction, the ring longitudinally compresses the outer annulus so as to constrict its inner circumference and thereby move said packer to constricted position, and upon movement of the piston in the opposite direction, said ring relieves the compression in said outer annulus so as to permit its inner circumference to expand and thereby permit said packer to move from constricted to retracted position.

14. An annular blowout preventer, comprising a housing having a bore extending longitudinally therethrough and an annular recess about the bore, a packer comprising an annulus of resilient material mounted in the recess for movement between an expanded position to open the bore and a constricted position to seal about a pipe in the bore or upon itself, another annulus of resilient material surrounding the packer within the recess for moving the packer from expanded to constricted position upon constriction of the inner circumference of the outer annulus, said housing having an annular cylinder therein and an annular guideway connecting the cylinder with the recess adjacent the outer circumference of the outer annulus, an annular piston longitudinally reciprocable within the cylinder, means for selectively admitting and exhausting operating fluid from and to the cylinder on opposite sides of the piston so as to reciprocate the piston therein, a sleeve connected to the piston and extending sealably through the guideway to surround the outer annulus within the recess, a ring extending radially inwardly from the sleeve and having an upper surface engageable with and substantially coextensive with the lower end of the outer annulus, whereby upon movement of the piston in one direction, the upper surface of the ring moves upwardly against the lower end of the outer annulus to longitudinally compress said outer annulus so as to constrict its inner circumference and thereby move said packer to constricted position, and upon movement of the piston in the opposite direction, said ring relieves the compression in said outer annulus so as to permit its inner circumference to expand and thereby permit said packer to move from constricted to retracted position.

15. An annular blowout preventer of the character defined in claim 14, wherein the piston is higher than the ring so as to lift the ring to compress the outer annulus.

16. An annular blowout preventer, comprising a housing having a bore extending vertically therethrough and an annular recess about the bore, a packer comprising an annulus of resilient material mounted in the recess for movement between an expanded position to open the bore and a constricted position to seal about a pipe in the bore or upon itself, another annulus of resilient material surrounding the packer within the recess for moving the packer from expanded to constricted position upon constriction of the inner circumference of the outer annulus, said housing having a cylinder means therein and guideway means connecting the cylinder means with the recess, piston means vertically reciprocable within the cylinder means, means for selectively admitting operating fluid to the cylinder means on one side of the piston means so as to move said piston means in one direction and exhausting fluid therefrom to permit said piston means to be moved in the opposite direction, a ring having a surface engageable with and substantially radially coextensive with one end of the outer annulus, means extending sealably through the guideway means and connecting the ring to the piston means, whereby upon movement of the piston means in said one direction, the ring longitudinally compresses the outer annulus so as to constrict its inner circumference and thereby move said packer from expanded to constricted position, and upon movement of the piston means in the opposite direction, said ring relieves the compression in said outer annulus to permit its inner circumference to expand and thereby permit said packer to move from constricted to expanded position, and means fluidly communicating the housing bore beneath the packer with said recess on the opposite surface of said ring, whereby a force due to the pressure of well fluid acting upon said outer annulus assists the force due to said operating fluid in moving the packer to and maintaining the packer in constricted position.

17. An annular blowout preventer of the character defined in claim 16, wherein the ring is lower than the piston means.

18. An annular blowout preventer of the character defined in claim 16, wherein the ring is beneath the annulus so that is upper surface moves upwardly against the lower end of the outer annulus to compress it.

19. An annular blowout preventer of the character defined in claim 18, wherein the piston means is higher than the ring so as to lift the ring to compress the outer annulus.

* * * * *